US008342705B2

(12) United States Patent
Yaksich

(10) Patent No.: US 8,342,705 B2
(45) Date of Patent: Jan. 1, 2013

(54) REMOVABLE WORK LIGHT ASSEMBLY FOR A HAND TOOL

(75) Inventor: Theodore G. Yaksich, Seneca, SC (US)

(73) Assignee: Jacobs Chuck Manufacturing Company, Clemson, SC (US)

( * ) Notice: Subject to any disclaimer, the term of this patent is extended or adjusted under 35 U.S.C. 154(b) by 713 days.

(21) Appl. No.: 12/552,061

(22) Filed: Sep. 1, 2009

(65) Prior Publication Data

US 2010/0053940 A1 Mar. 4, 2010

Related U.S. Application Data

(60) Provisional application No. 61/093,641, filed on Sep. 2, 2008.

(51) Int. Cl.
*B25B 23/16* (2006.01)

(52) U.S. Cl. ..... 362/109; 362/119

(58) Field of Classification Search ..... 362/109, 362/119

See application file for complete search history.

(56) References Cited

U.S. PATENT DOCUMENTS

| | | | | |
|---|---|---|---|---|
| 5,152,598 | A * | 10/1992 | Schaffer | 362/577 |
| 6,502,949 | B1 * | 1/2003 | Horiyama et al. | 362/119 |
| 6,575,590 | B1 | 6/2003 | Wadsworth | |
| 6,616,295 | B2 * | 9/2003 | Sako et al. | 362/119 |
| 6,729,743 | B2 * | 5/2004 | Gillette | 362/191 |
| 6,964,545 | B1 * | 11/2005 | Languasco | 408/16 |
| 7,101,058 | B2 * | 9/2006 | Prell et al. | 362/191 |
| 7,200,516 | B1 * | 4/2007 | Cowley | 702/151 |
| 7,357,526 | B2 | 4/2008 | Zeiler | |

FOREIGN PATENT DOCUMENTS

| | | |
|---|---|---|
| DE | 3525980 | 1/1987 |
| GB | 2407058 | 4/2005 |
| WO | 99/02310 | 1/1999 |

OTHER PUBLICATIONS

Communication Relating to the Results of the Partial PCT International Search dated Dec. 15, 2009 for PCT/US2009/055656 filed on Sep. 2, 2009, corresponding to co-pending U.S. Appl. No. 12/552,061.

International Search Report and the Written Opinion of the International Searching Authority for co-pending PCT Application No. PCT/US2009/055656, dated Mar. 9, 2010.

* cited by examiner

*Primary Examiner* — Anabel Ton

(74) *Attorney, Agent, or Firm* — Nelson Mullins Riley & Scarborough, LLP

(57) ABSTRACT

A work light assembly for use with a hand drill or like rotary tool having a work light, a side handle assembly, and an attachment assembly, where the work light is removably secured to a portion of the rotary tool.

15 Claims, 14 Drawing Sheets

REMOVABLE WORK LIGHT ASSEMBLY FOR A HAND TOOL

CLAIM OF PRIORITY

The present invention claims priority to U.S. Provisional Patent Application No. 61/093,641, entitled "Removable Work Light for a Hand Drill," filed Sep. 2, 2008, the entire disclosure of which is incorporated by reference herein.

FIELD OF THE INVENTION

The present invention is directed to a work light assembly for a hand drill. More specifically, the work light assembly may or may not include a side handle and may be removably attached to a manually or power-operated drill, or like rotary tool.

BACKGROUND OF THE INVENTION

Hand drills may be utilized in a variety of environments, including those that may not include proper lighting. Existing light sources that have been developed for hand drills typically shine light in only a fixed direction and are located on a portion of the hand drill that may interfere with the user's use of the drill. Additionally, the power for the light source is provided by the hand drill itself, which typically provides a weak source of light, and may interfere with the power of the drill. Finally, typical light sources for hand drills are developed to adapt to a particular drill and may not be utilized interchangeably on various brands and structures. As such, there is a need for a source of light to be utilized on hand drills that overcomes the deficiencies of the current technology.

SUMMARY OF THE INVENTION

In one embodiment of the present invention, a work light assembly for use with a hand drill or like rotary tool with a work light, a side handle assembly, and an attachment assembly. The work light assembly is removably secured to a portion of the rotary tool.

In a further embodiment of the invention, a work light assembly for use with a hand drill or like rotary tool with a work light and an attachment assembly. The work light is rotatable relative to the attachment assembly and the work light assembly is removably secured to a portion of the rotary tool.

In an even further embodiment of the invention, a work light assembly for use with a hand drill or like rotary tool with a work light, a side handle assembly and an attachment assembly with a ring. The work light assembly is removably secured to a cylindrical portion of the rotary tool with the ring.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which refers to the appended Figures, in which.

Figure 1:
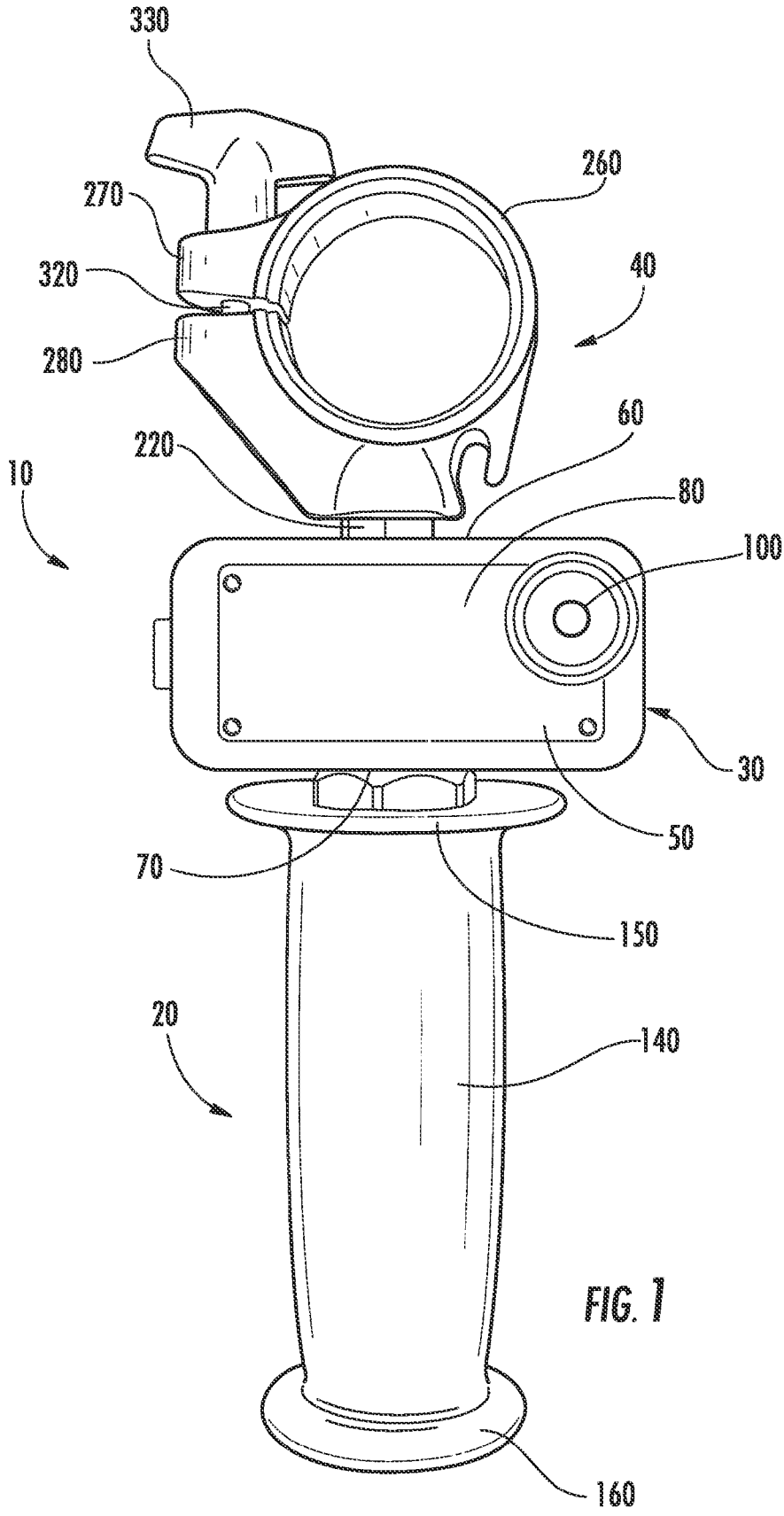
FIG. 1 is a front view of a removable work light assembly, in accordance with a first embodiment of the present invention, including a work light, a side handle assembly and a resilient ring as an attachment assembly.

Repeat use of reference characters in the present specification and drawings is intended to represent same or analogous features or elements of the invention.

DETAILED DESCRIPTION OF THE INVENTION

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring now to the figures, FIGS. 1 through 5C show a work light assembly 10 that is configured to be removably attached to a hand drill (FIGS. 5A-5C), angle grinder, or similar tool, in accordance with a first embodiment of the present invention. Removable work light assembly 10 includes a side handle assembly 20, a work light 30, and an attachment assembly 40.

Figure 2:
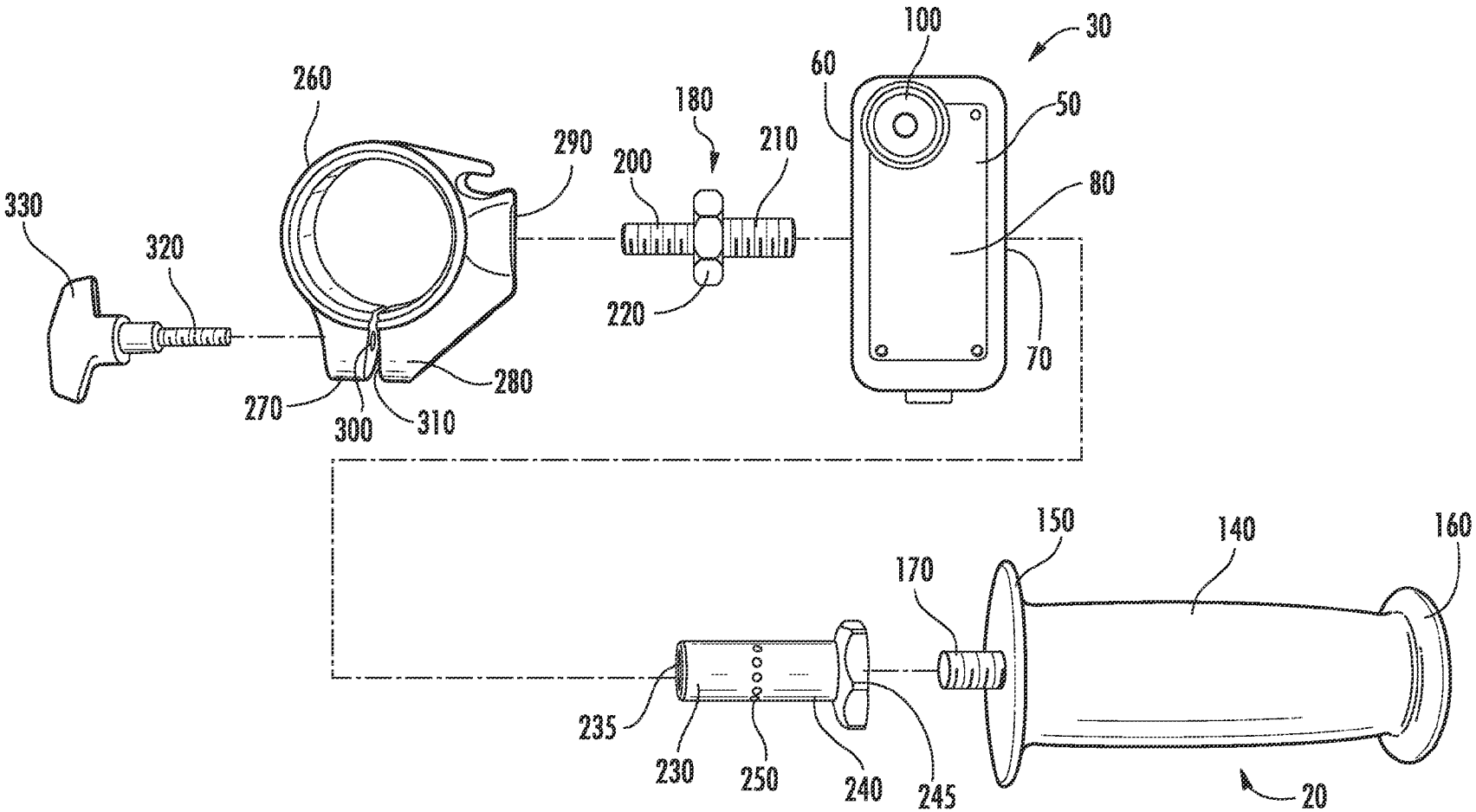
FIG. 2 is an exploded view of the work light assembly as shown in FIG. 1.
Figure 3A:
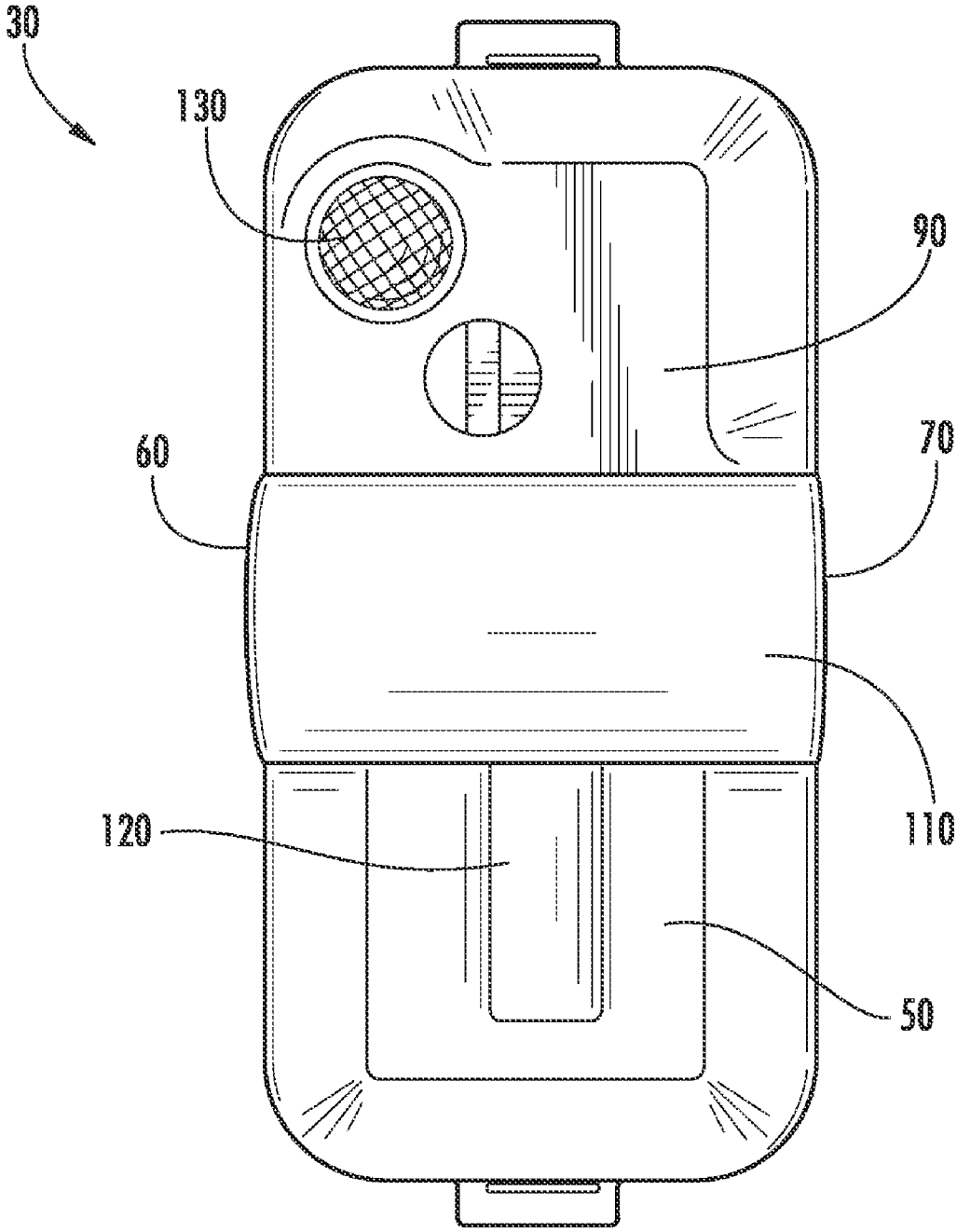
FIG. 3A is a rear view of the work light as shown in FIG. 1.
Figure 3B:
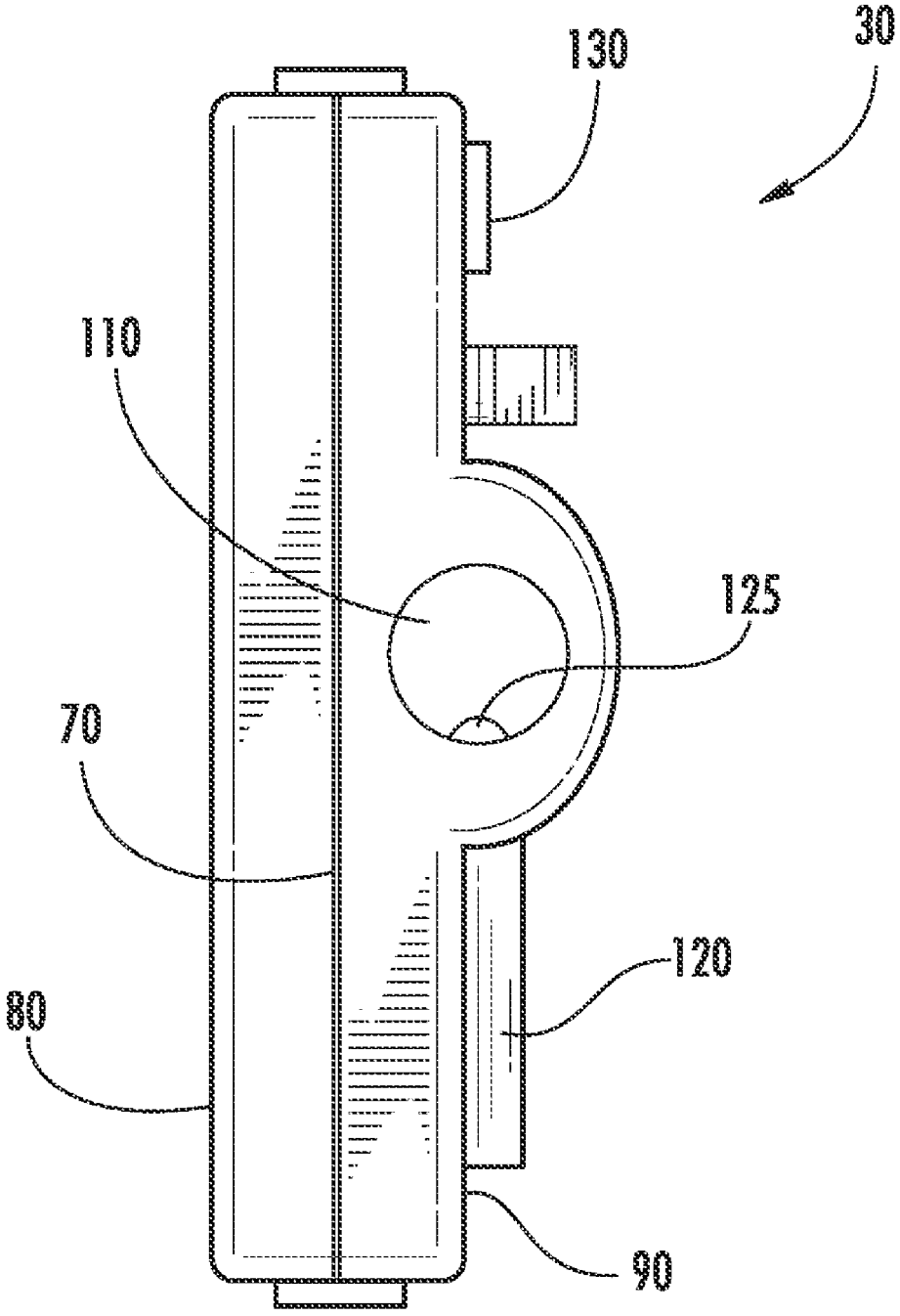
FIG. 3B is a side view of the work light as shown in FIG. 1.

As shown in FIGS. 1 through 3B, work light 30 includes a housing 50, including a front portion 80 and a rear portion 90, an on/off switch 130, batteries (not shown) within housing 50, and a light emitting diode (LED) 100, which can be illuminated in a general direction of the user's choosing. A hollow bore 110 is located on housing rear portion 90 of work light 30 and extends from a first side 60 to a second side 70 of work light 30. Hollow bore 110 is configured to rotatably receive a threaded rod 190 (FIG. 2), as discussed in greater detail below. Located perpendicular to and intermediate the ends of hollow bore 110 is a vertical chamber 120 that houses a ball bearing 125 and a spring (not shown). As best seen in FIG. 3B, ball bearing 125 and the spring are situated such that the spring urges a portion of ball bearing 125 to extend into hollow bore 110 of work light 30.

As shown, LED 100 is fixed relative to work light 30 and therefore illuminates the area in the general direction to which work light 30 is directed. In additional embodiments, however, LED 100 may be pivotally secured within housing 50 of work light 30, thereby allowing LED 100 to be angled relative to work light 30 for directional lighting.

As well, although work light 30 as shown in FIGS. 1 through 3B has one LED 100, it should be understood that more than one LED 100 may be used in additional embodiments. For example, work light 30 could include two, three, four or more LEDs. When more than one LED is utilized, the LEDs may be arranged in any configuration on work light 30 to meet the specifications of the user. In some embodiments, an LED may be placed on both front housing portion 80 and rear housing portion 90 of work light 30 such that the LEDs are separated by approximately 180°.

As noted, work light 30 of FIGS. 1 through 3B further includes an on/off switch 130 used to illuminate LED 100. On/off switch 130 may be placed on any portion of work light assembly 10 that will allow the user access while the invention is in use. In those embodiments with multiple LEDs, on/off switch 130 may also serve to select the number of LEDs that are providing light. For example, on/off switch 130 may be pressed a first time to energize a single LED, a second time to energize two LEDs, etc, until it is pressed enough times to de-energize all the LEDs when no longer needed.

Handle assembly 20 includes a handle 140 which may be constructed in the same fashion as side handles for use on other manually or power-operated drills, or like rotary tools, and a threaded stem 170. Handle 140 may be assembled from any suitable material and may include plastic, metal, or both. In some embodiments, handle 140 may contain an outer surface which includes a rubber-like material in order to provide a sure grip and greater comfort for the user. Handle 140 may further contain advertisement for the product being sold, including a product identifier, source identifier, product logos and/or trademarks.

Threaded stem 170 of handle assembly 20 extends outwardly from a first end 150 of handle 140. Threaded stem 170 allows handle assembly 20 to be removably secured to either threaded rod 180 or a hand drill or like rotary tool, as discussed in greater detail below. A second end 160 of handle 140 is partially flattened such that, as shown in FIG. 1, second end 160 of handle 140 may be used to allow work light assembly 10 to stand erect on a surface so that LED 100 may be used as a stand-alone light source even when it is not connected to a power-operated drill or like rotary tool.

As shown in FIGS. 1 and 2, attachment assembly 40 is disposed adjacent work light 30, opposite to side handle assembly 20. Attachment assembly 40 includes an attachment screw 180 and an internally threaded rod 190. Attachment screw 180 has a first threaded end 200 and a second threaded end 210, and preferably, a hexagonally shaped nut 220 located intermediate first and second threaded ends 200, 210. Internally threaded rod 190 has a first end 230 with a threaded bore 235 and a second end 240 with a threaded bore 245. An annular array of detents 250 extends around the entire outer circumference of internally threaded rod 190 intermediate its first and second ends 230, 240.

Internally threaded rod 190 may be utilized to establish a rotatable connection between work light 30 and handle assembly 20 or between work light 30 and attachment screw 180 or both. In operation, threaded bore 245 of second end 240 of internally threaded rod 190 mates with threaded stem 170 of handle 140 and threaded bore 235 of first end 230 of internally threaded rod 190 mates with second threaded end 210 of attachment screw 180. Further, internally threaded rod 190 is situated through hollow bore 110 of work light 30 and at least one of the detents 250 of internally threaded rod 190 mates with the portion of ball bearing 125 that extends into hollow bore 110. As such, ball bearing 125 and internally threaded rod 190 are held in place by the force of the spring. The connection between ball bearing 125 and at least one detent 250 allows the user to rotate work light 30 in a circular direction, where ball bearing 150 mates with each of the detents 250 along internally threaded rod 190.

Figure 5A:
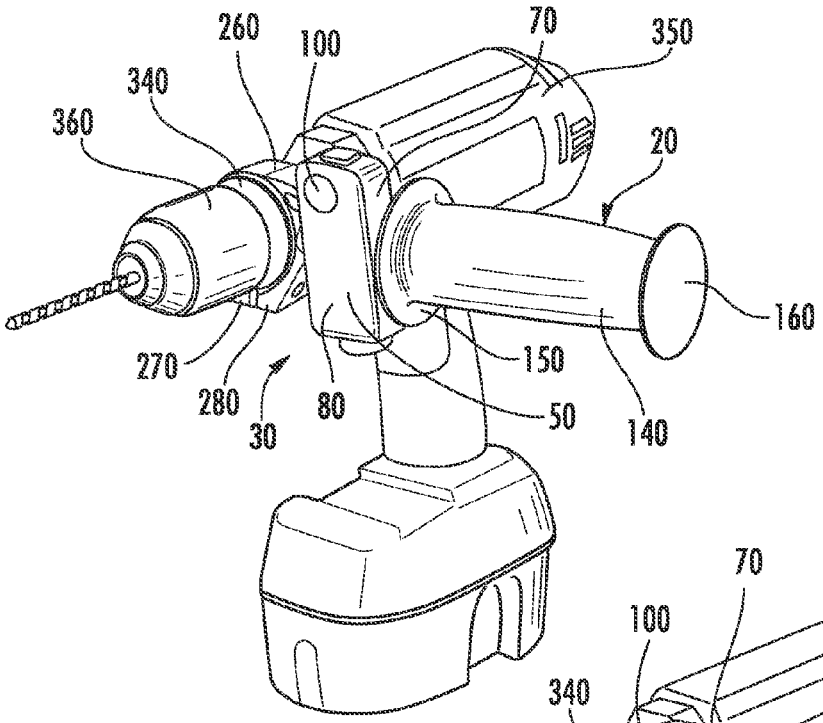
FIG. 5A is a perspective view of the work light assembly as shown in FIG. 1, wherein the work light assembly is connected to a drill.
Figure 5B:
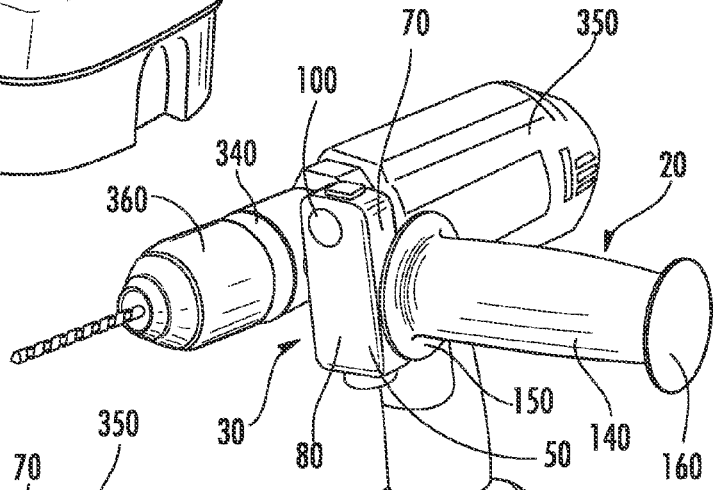
FIG. 5B is a perspective view of the work light assembly, wherein the work light assembly is connected to a drill by an attachment screw.
Figure 5C:
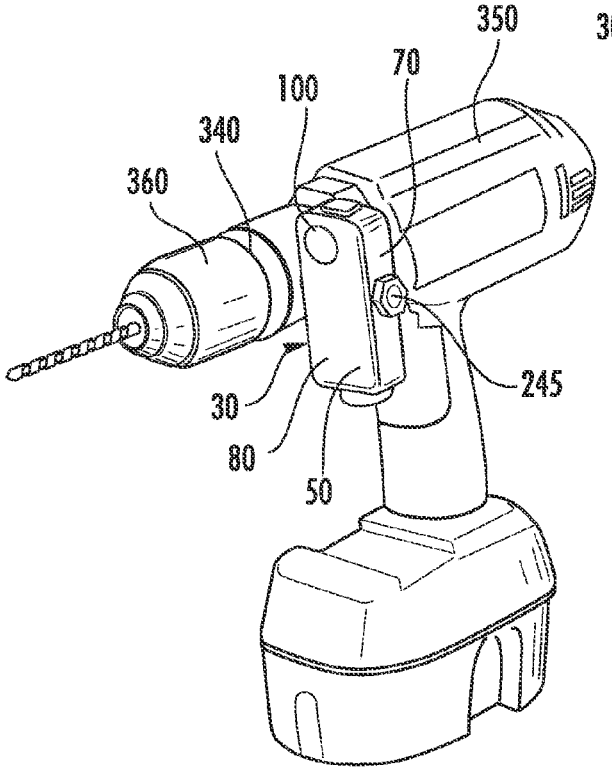
FIG. 5C is a perspective view of the work light assembly, wherein the side handle assembly has been removed and the work light assembly is connected to a drill by an attachment screw.

First end 200 of attachment screw 180 may be used to mate with a threaded bore (not shown) of a drill or like rotary tool as shown in FIG. 5B. Because the threaded bore of a drill may be of varying sizes depending on the particular drill utilized, first end 200 of attachment screw 180 may also have varying diameters. For example, first end 200 of attachment screw 180 may have a diameter of 0.25 inches, 0.375 inches, 0.5 inches, 0.625 inches, or 0.75 inches. The threaded bore of the drill will dictate the necessary size of first end 200 of attachment screw 180.

If the drill or like rotary tool does not contain a threaded bore, then additional components may be utilized for proper connection of work light assembly 10. For example, as shown in FIG. 1, attachment assembly 40 may further include a resilient ring 260 that includes a first end 270 and a second end 280 and a threaded bore 290. Threaded bore 290 of resilient ring 260 mates with first end 200 of attachment screw 180 when resilient ring 260 is utilized as part of attachment assembly 40. First end 270 of resilient ring 260 further includes a hollow throughput 300 and second end 280 of resilient ring 260 includes a threaded channel 310. Resilient ring 260 is constructed such that the circumference of resilient ring 260 may be expanded by pulling first end 270 and second end 280 in opposite directions. Hollow throughput 300 and threaded channel 310 are configured in a manner such that when first end 270 and second end 280 are in contact with one another, hollow throughput 300 and threaded channel 310 are also in contact. Resilient ring 260 further includes a screw 320 with a shaped end 330. As shown, shaped end 330 of screw 320 is configured as a "T" to aid the user in rotating screw 320. Although shaped end 330 is shown with a "T" configuration, it should be understood that shaped end 330 may be configured in any manner so as to aid the user in rotating screw 320. For example, shaped end 330 may be constructed similar to the end of a thumb screw or a wing screw. Shaped end 330 may also include a rubber-like material or indentions to provide the user greater comfort or ease in rotating screw 320.

In operation, resilient ring 260 may be applied to a front portion 340 of the front of a hand drill 350 as shown in FIG. 5A. The circumference of resilient ring 260 is increased by the user pulling first end 270 and second end 280 away from one another and passing resilient ring 260 over the drill chuck 360 and onto front portion 340 on the front of drill 350. Before securing resilient ring 260 to front portion 340 of the front of hand drill 350, work light 30 and side handle assembly 20 may be rotated 360° in a plane perpendicular to front portion 340 of hand drill 350 so that the user may position side handle assembly 20 as desired before use. For example, FIG. 5A illustrates side handle assembly 20 directed to a side of hand drill 350. Alternatively, however, side handle assembly 20 may be positioned vertically and placed either above or below hand drill 350. Once resilient ring 260 is fit over the appropriate portion of hand drill 350, and side handle assembly 20 and work light 30 are positioned as desired, resilient ring 260 may be secured to front portion 340 of hand drill 350. In order to secure resilient ring 260, screw 320 is placed through hollow throughput 300 of first end 270 and mates with threaded channel 310 of second end 280. As the user turns shaped end 330 to rotate screw 320 into threaded channel 310, first end 270 and second end 280 move closer in contact with one another until the circumference of resilient ring 260 is such a size that it creates a secure connection to front portion 340 of the front of hand drill 350.

With the use of additional components, attachment assembly 40 may be utilized to attach removable work light assembly 10 to items other than a drill or like rotary tool. In such situations, as seen in FIGS. 4A through 4D, a mounting attachment 370 may be utilized to allow for additional connections. Mounting attachment 370 contains a front portion 380, a rear portion 390, a hook 400 and a threaded bore 410. Threaded bore 410 of mounting attachment 370 is used to mate with first end 200 of attachment screw 180 of attachment assembly 40. Threaded bore 410 of mounting attachment 370 is located intermediate front and rear portions 380, 390. Rear portion 390 is equipped with a magnet 420 which may be used to attach work light assembly 10 to a magnetic surface. Further, hook 400 is located proximate rear portion 390 and may be used to facilitate a connection of work light assembly 10 to an object so as to provide the user with lighting from work light assembly 10.

Figure 4A:
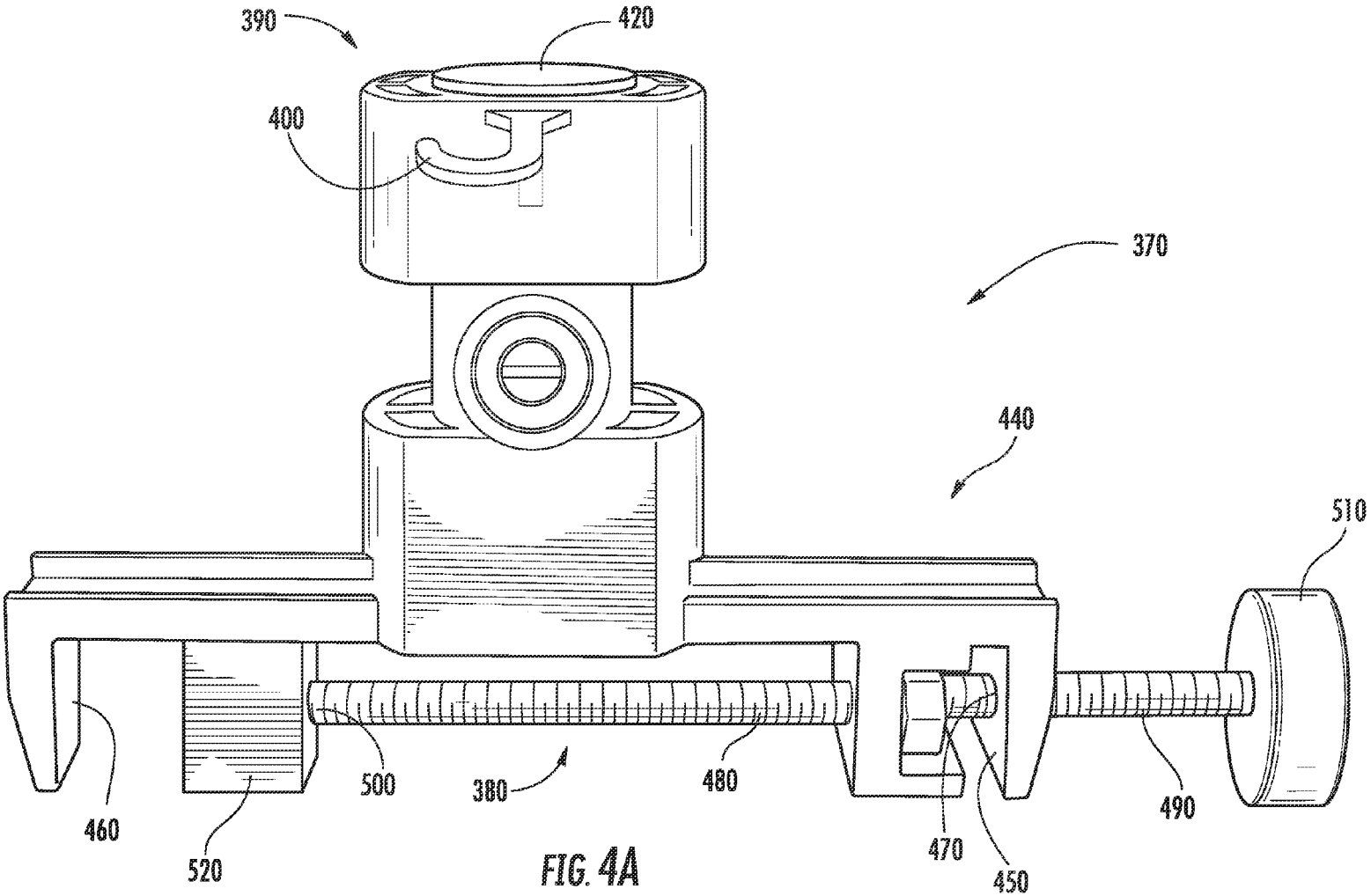
FIG. 4A is a top view of a mounting attachment, in accordance with the first embodiment of the invention.
Figure 4B:
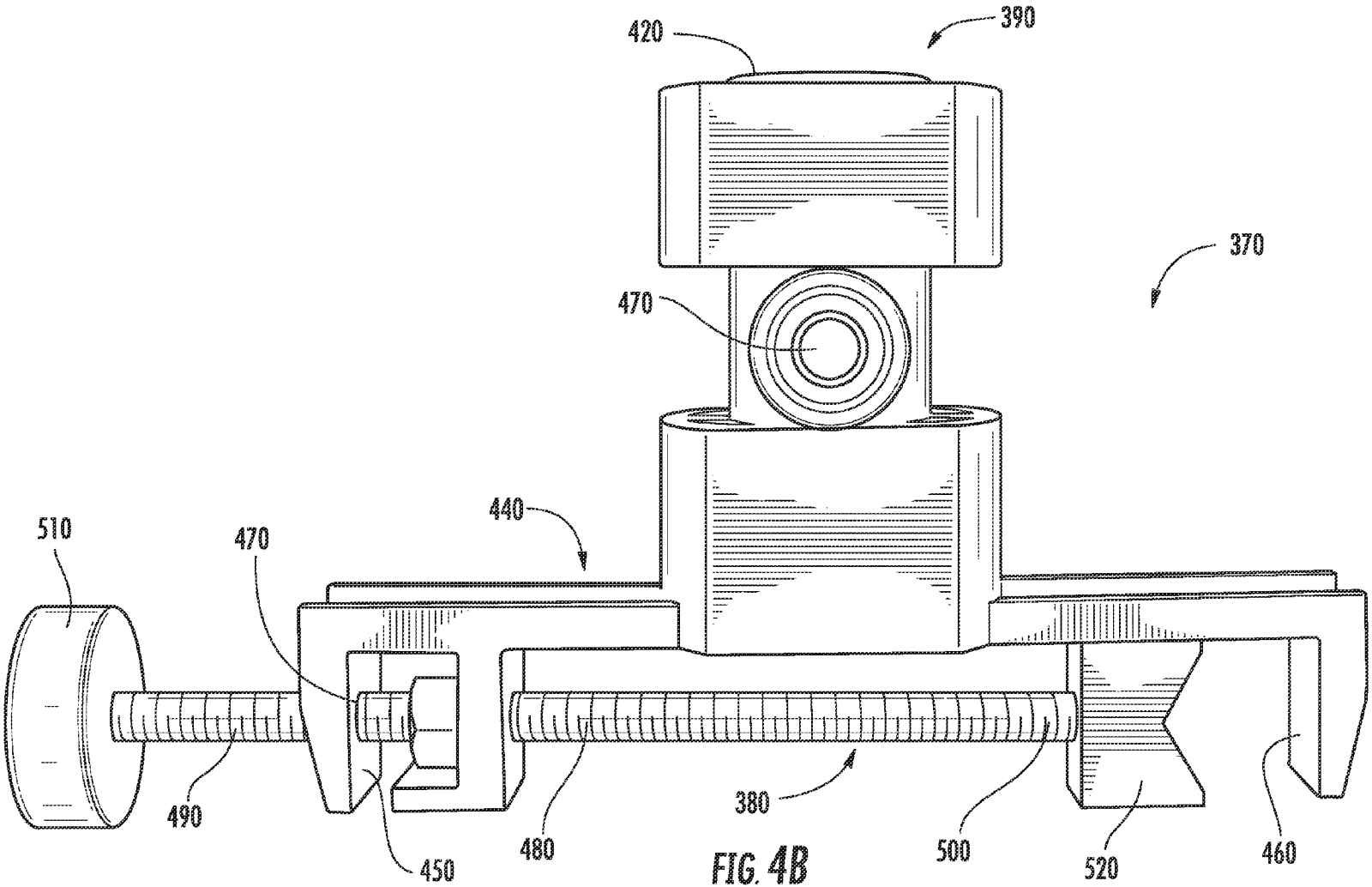
FIG. 4B is a bottom view of the mounting attachment, as shown in FIG. 4A.
Figure 4C:
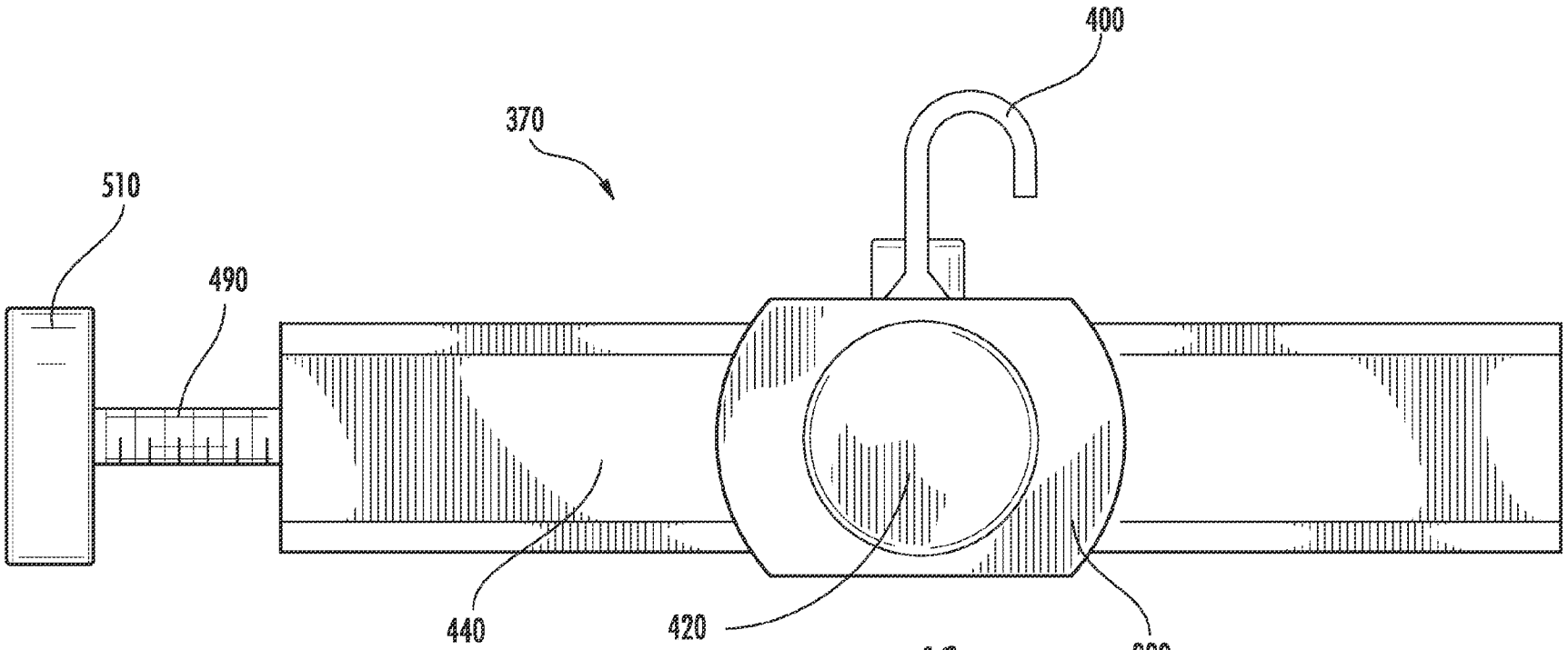
FIG. 4C is a rear view of the mounting attachment as shown in FIG. 4A.
Figure 4D:
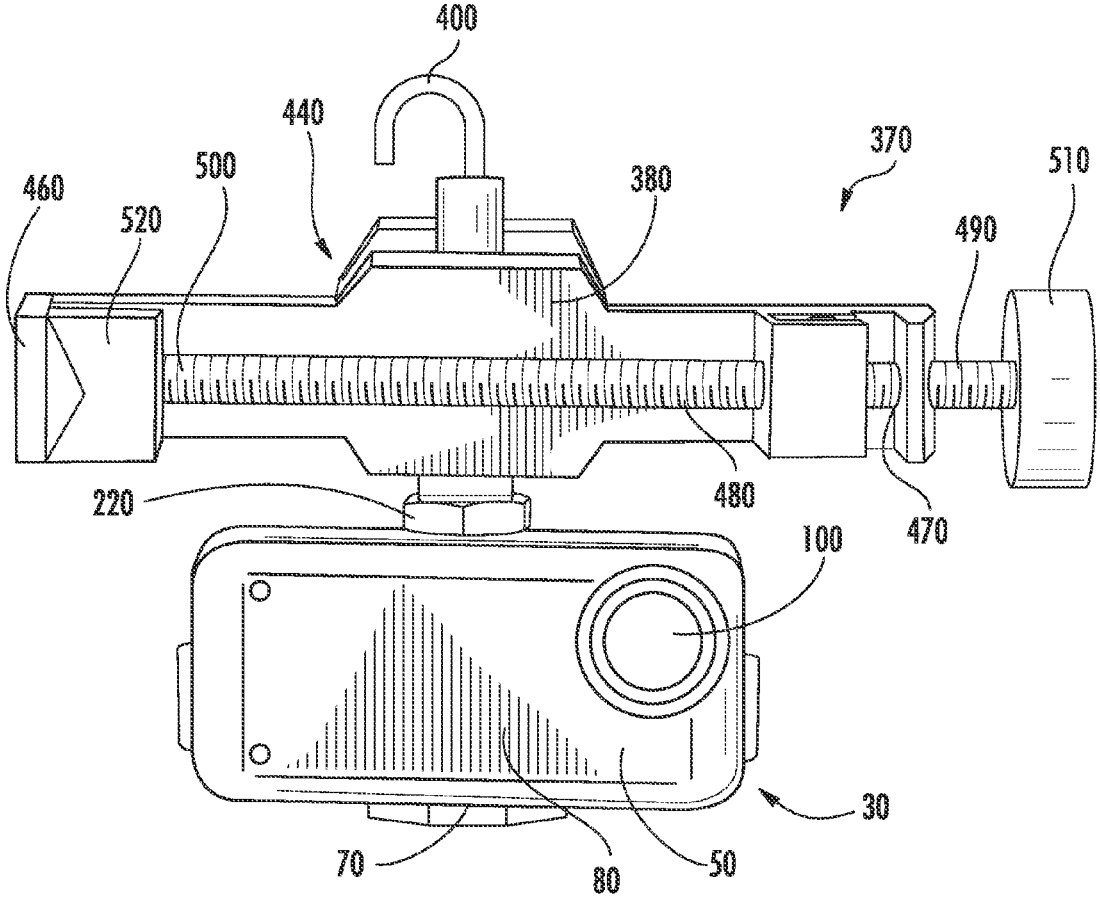
FIG. 4D is a front view of the removable work light assembly as shown in FIG. 1, further including the mounting attachment as shown in FIG. 4A, as an attachment assembly.

Front portion 380 of mounting attachment 370 contains a clamp 440 which may be constructed of two opposing ends 450, 460, both of which are stationary. The first end 450 contains a threaded hole 470 that may facilitate the use of a clamping screw 480. Clamping screw 480 also contains a first end 490 and a second end 500. First end 490 of clamping screw 480 is affixed with a wheel 510 in order to facilitate the turning of the clamping screw 480. Second end 500 of clamping screw 480 includes a cushioned cube 520 that makes contact with second end 460 of clamp 440 when clamping screw 480 is fully engaged within clamp 440. As seen from the figures, cushioned cube may be configured to more properly attach to various objects. For example, as seen in FIG. 4A, cushioned cube 520 has a flat face to connect to objects that are also flat, however, as seen in FIG. 4B, cushioned cube 520 contains an inward slanting face to properly connect to rounded items, such as pipes.

In operation, a user turns clamping screw 480 in a counter clockwise (ccw) direction to create an appropriate amount of space between cushioned cube 520 and second end 460 of clamp 440 to receive an object for connection. Once the space between cushioned cube 520 and second end 460 of clamp 440 receives the object, the user rotates clamping screw 480 in a clockwise direction (cw) until a sufficient connection is made within the clamp 440.

Based on the invention described above, when work light assembly 10 is attached to a hand drill 350, LED 100 of the present invention can be placed close enough to the surface where a user is drilling without adversely effecting the balance, or the function of the drill. Further, with the use of a batteries located within housing 50, LED 100 is illuminated by a source other than the power source of the hand drill. Also, LED 100 of the present invention can be made of a sufficient size in order to properly illuminate the area surrounding the work area of the user, and is resistant to potential damage from vibration, dropping, etc.

Figure 6:
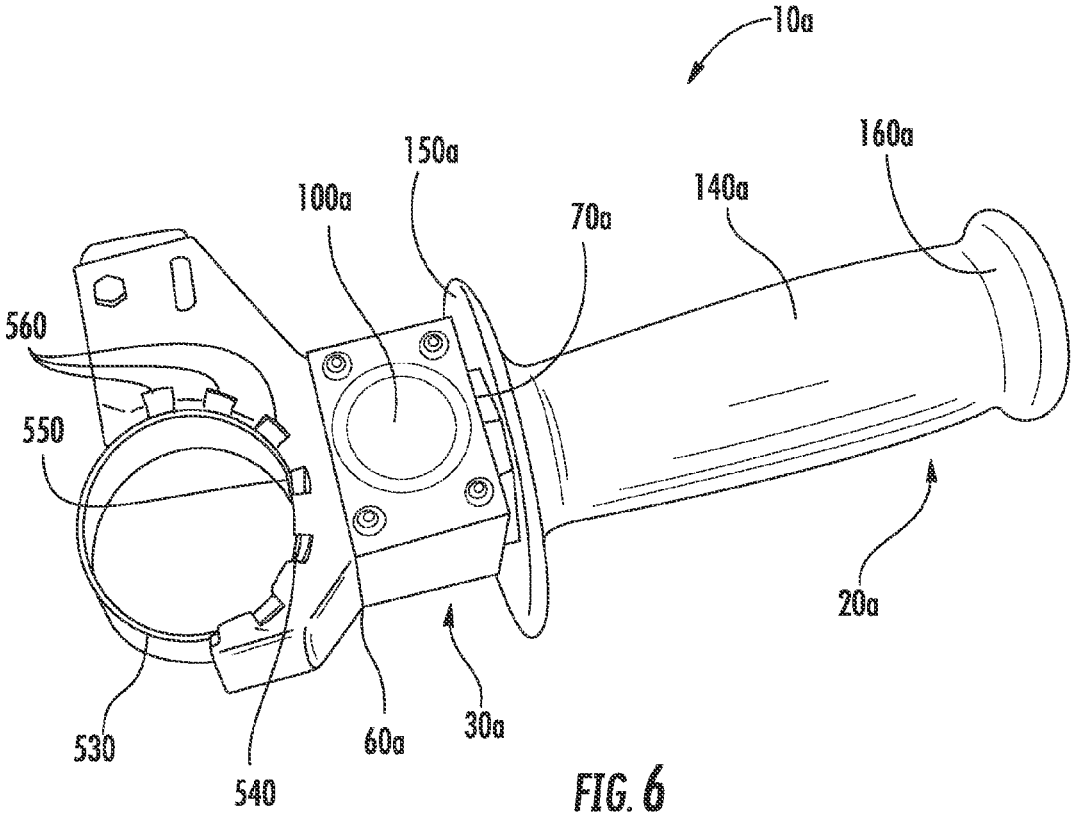
FIG. 6 is a front perspective view of a removable work light assembly, in accordance with a second embodiment of the present invention, wherein the removable work light assembly includes a side handle.
Figure 7:
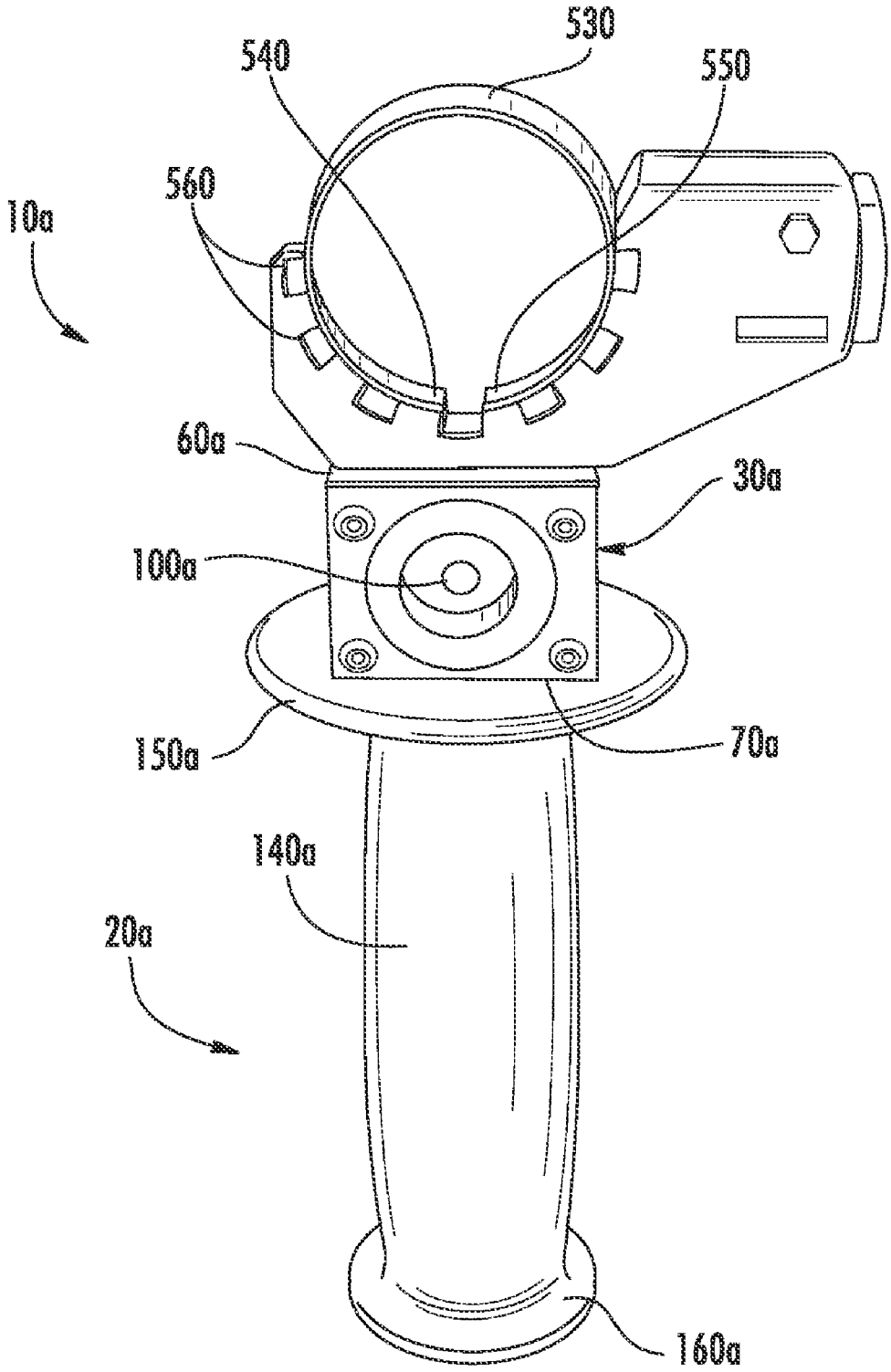
FIG. 7 is a front perspective view of the work light assembly as shown in FIG. 6, wherein the work light assembly is being operated as a stand-alone work light.
Figure 8:
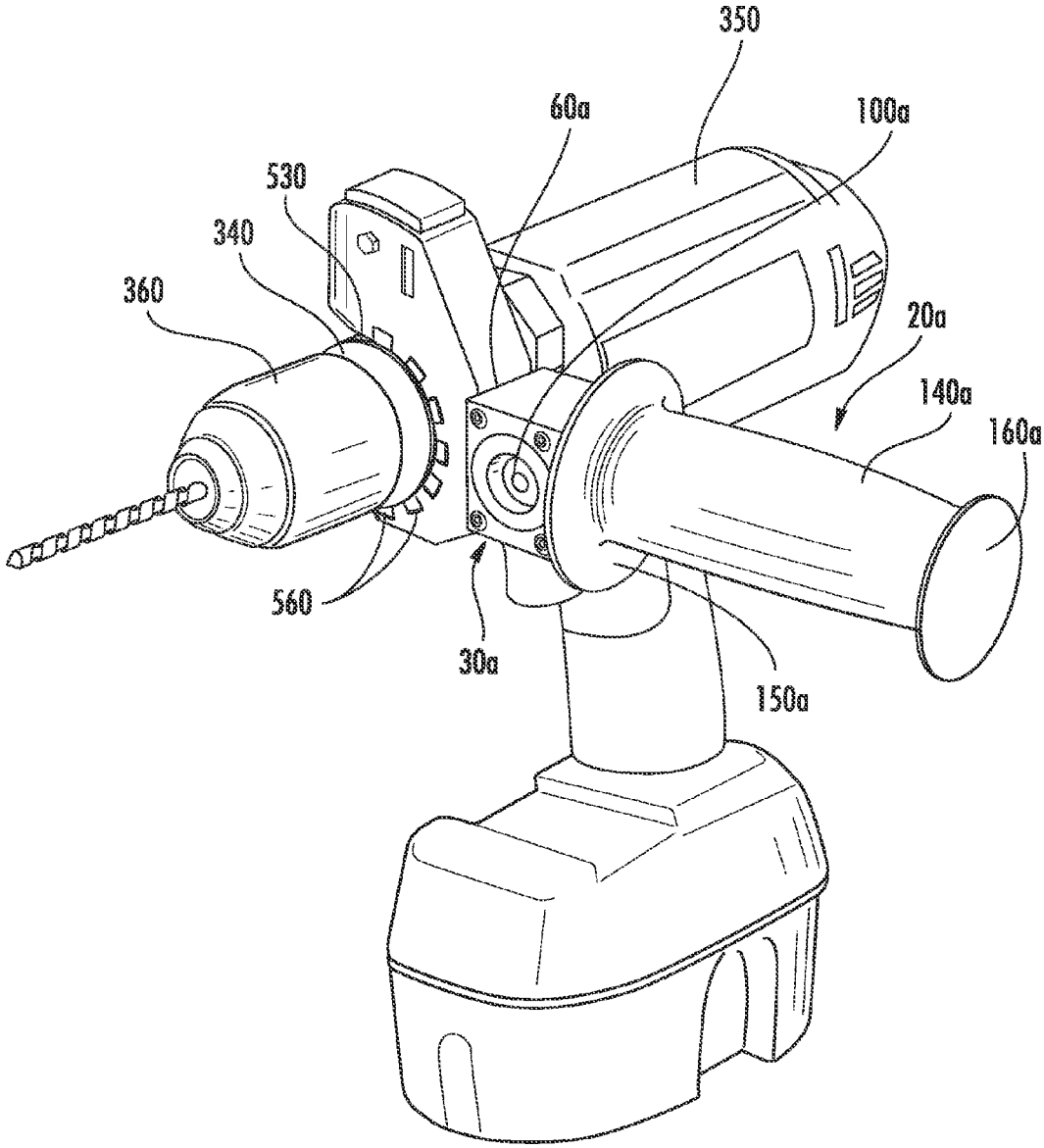
FIG. 8 is a perspective view of the work light assembly as shown in FIG. 6, wherein the work light assembly is connected to a drill.

Referring now to FIGS. 6 through 8, a second embodiment of work light assembly 10*a* is shown. In contrast to the first embodiment, on/off switch 130*a* of second embodiment is placed on bottom end 160 of handle assembly 20*a*. This configuration still enables the user to reach on/off 130*a* switch while work light assembly 10*a* is in use. Additionally, batteries are placed within a battery compartment located within handle 140*a* and not within work light 30, as with the first embodiment.

In further contrast with the first embodiment, as shown in FIG. 6, attachment assembly 40*a* of the second embodiment includes a ring 530 with a first end 540 and a second end 550. The diameter of ring 530 may be expanded by rotating handle 140*a* in an appropriate direction (in the embodiment shown, the direction is counter-clockwise (ccw) when viewing handle from second end 160*a*). As handle 140 is rotated to expand the diameter of ring 530, first end 540 and second end 550 move to notches 560 further away from the longitudinal center axis of removable work light assembly 10*a*, thereby creating a larger diameter of ring 530. After the diameter has reached a suitable distance, ring 530 is passed over drill chuck 360 and onto front portion 340 of the front of a hand drill 350, as shown in FIG. 8. Once attachment assembly 40*a* is placed on the appropriate front portion 340 of the front of hand drill 350, and side handle assembly 20*a* is positioned to meet the user's specifications as stated with respect to the first embodiment, attachment assembly 40*a* may be secured to front portion 340 of the front of hand drill 350. The diameter of ring 530 is reduced by rotating handle 140*a* in the opposite direction to that which caused the diameter of ring 530 to increase [clockwise (cw) as shown]. Rotating side handle 140*a* in this manner causes first and second ends, 540, 550, to move to notches 560 located closer to the longitudinal center axis of work light assembly 10*a*. The diameter of ring 530 should be reduced to a size such that attachment assembly 40*a* makes a secure connection with hand drill 350 as shown in FIG. 8.

Figure 9:
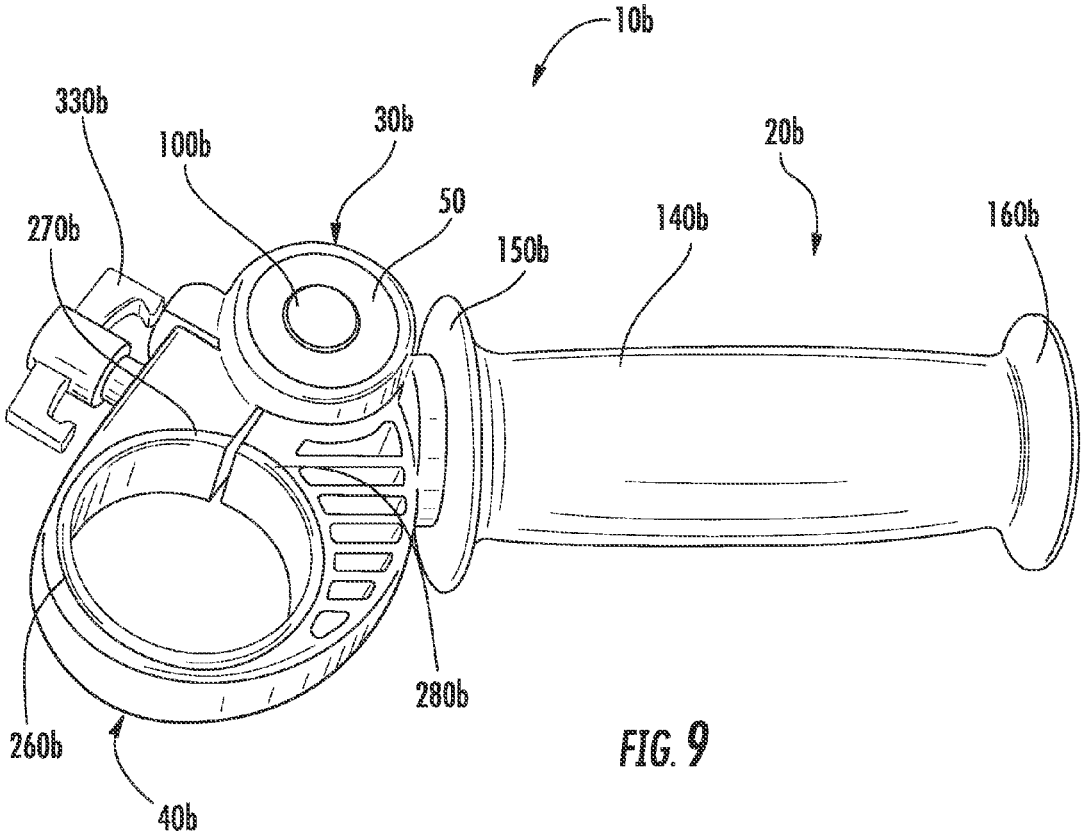
FIG. 9 is a front perspective view of a removable work light assembly, in accordance with a third embodiment of the present invention, wherein the work light assembly includes a side handle.
Figure 10:
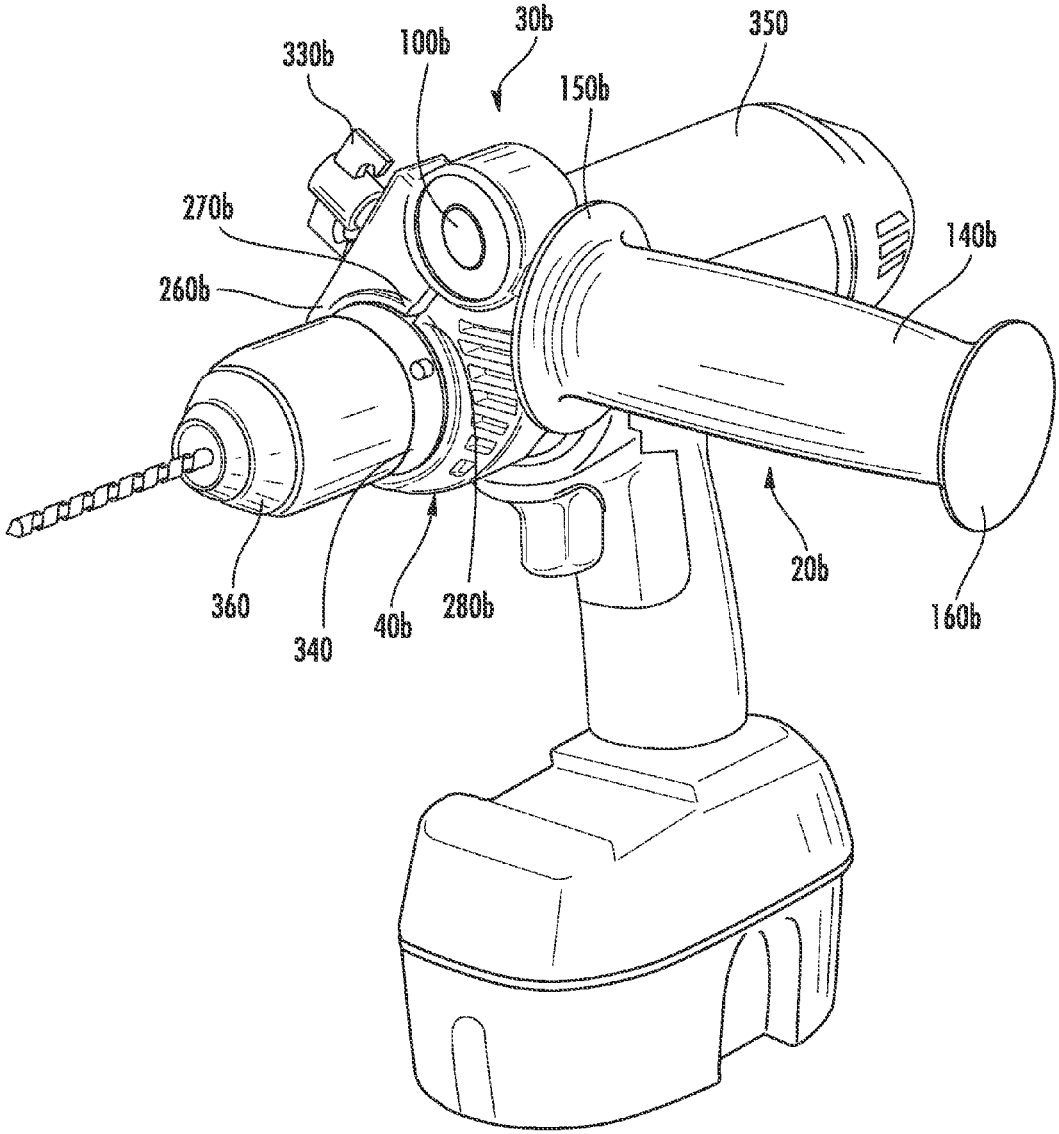
FIG. 10 is a perspective view of the work light assembly as shown in FIG. 9, wherein the work light assembly is connected to a drill.

Referring now to FIGS. 9 and 10, a third embodiment of removable work light assembly 10*b* is shown. In contrast to the first embodiment, work light 30*b*, side handle assembly 20*b* and attachment assembly 40*b* are shown in an offset configuration rather than a linear configuration. In other words, in the third embodiment, when removable work light 10*b* is stood erect on second end 160 of handle 140*b*, work light 30*b* and attachment assembly 40*b* are not disposed along a longitudinal counter axis of handle assembly 20*b*. In further contrast to the first embodiment, on/off switch 130*b* of the third embodiment is located on rear portion 90*b* of housing 30*b* and the batteries are located within handle 140*b* as with the second embodiment. Again, this configuration still enables the user to reach on/off switch 130*b* while removable work light assembly 10*b* is in use.

As shown in FIG. 9, attachment assembly 40*b* of the third embodiment includes a resilient ring 260*b* similar to resilient ring 260 discussed with respect to the first embodiment and may be utilized to attach work light assembly 10*b* to a drill or like rotary tool as shown in FIG. 10. Resilient ring 260*b* of the third embodiment, however, is permanently affixed to work light 30*b* and handle assembly 20*b*, and accordingly, resilient ring 260*b* does not include a threaded bore in which to attach to worklight 30*b*.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole and in part. Furthermore, those of ordinary skill in the art will appreciate that the foregoing description is by way of example only, and is not intended to limit the invention so further described in such appended claims. Therefore, the spirit and scope of the appended claims should not be limited to the description of the preferred versions contained therein.

The invention claimed is:

1. A work light assembly for a rotary tool, comprising:

a work light including a housing defining a hollow bore;

a side handle assembly including a rod extending outwardly therefrom; and an attachment assembly, wherein the work light assembly is removably secured to a portion of the rotary tool, the side handle assembly is removably secured to the attachment assembly, and the rod of the side handle assembly is removably inserted in the hollow bore of the work light housing such that the work light may be rotated about the rod.

2. The work light assembly of claim 1, wherein the work light is pivotable relative to the side handle assembly.

3. The work light assembly of claim 1, wherein the attachment assembly further comprises a threaded stem that extends outwardly from the work light assembly such that the work light assembly can be removably connected to the rotary tool, wherein the threaded stem is received in a threaded bore located on a portion of the rotary tool.

4. The work light assembly of claim 3, wherein a diameter of the threaded stem of the attachment assembly is one of 0.25 inches, 0.375 inches, 0.5 inches, 0.625 inches, or 0.75 inches.

5. The work light assembly of claim 1, wherein the attachment assembly further comprises a ring with an adjustable circumference, wherein the ring is configured to secure the work light assembly to a cylindrical portion of the rotary tool.

6. The work light assembly of claim 5, wherein the work light assembly may be rotated 360° in a plane perpendicular to the cylindrical portion of the rotary tool.

7. The work light assembly of claim 1, wherein the attachment assembly further comprises, a resilient ring with a first end having a threaded bore and a second end having a hollow throughput; and a threaded screw, wherein the threaded screw extends through hollow throughput and is mated with the threaded bore such that the circumference of the resilient ring is adjustable by rotation of the threaded screw.

8. The work light assembly of claim 1, wherein the housing of the hollow bore further comprises a first and second end and a ball bearing that is partially extended within a portion of the hollow bore on one end and is mated with a spring on an opposite end;

wherein the rod of the side handle further comprises a series of detents formed in a circle around the rod; and wherein the portion of the ball bearing partially extended within a portion of the hollow bore mates with the series of detents on the rod such that the work light may be rotated about the rod.

9. A work light assembly for a rotary tool, comprising:

a work light including a housing defining a hollow bore;

an attachment assembly; and a side handle assembly including a rod that extends rotatably therefrom, the rod of the side handle assembly being removably inserted in the hollow bore of the work light housing such that the work light may be rotated about the rod, wherein the work light is rotatable relative to the attachment assembly, wherein the work light assembly is removably secured to a portion of the rotary tool, wherein the housing of the hollow bore further comprises a first and second end and a ball bearing that is partially extended within a portion of the hollow bore on one end and is mated with a spring on an opposite end, wherein the rod of the side handle further comprises a series of detents formed in a circle around the rod, and wherein the portion of the ball bearing partially extended within a portion of the hollow bore mates with the series of detents on the rod such that the work light may be rotated about the rod.

10. The work light assembly of claim 9, wherein the attachment assembly further comprises a threaded stem that extends outwardly from the work light assembly such that the work light assembly can be removably connected to the rotary tool, wherein the threaded stem is received in a threaded bore located on a portion of the rotary tool.

11. The work light of claim 9, wherein the attachment assembly further comprises a mounting assembly with a clamp, wherein the clamp is configured to secure the work light assembly to an object.

12. The work light of claim 11, wherein the mounting assembly further comprises a magnet, wherein the magnet is configured to secure the work light assembly to a magnetic object.

13. The work light of claim 11, wherein the mounting assembly further comprises a hook, wherein the hook is configured to connect the work light assembly to an object.

14. A work light assembly for a hand drill or like rotary tool comprising:

a work light;

a side handle assembly; and an attachment assembly further comprising a ring, wherein the work light assembly is removably secured to a cylindrical portion of the rotary tool with the ring.

15. The work light assembly of claim 14, wherein the ring of the attachment assembly further comprises:

a first end having a threaded bore and a second end having a hollow throughput; and a threaded screw, wherein the threaded screw extends through hollow throughput and is mated with the threaded bore such that the circumference of the ring is adjustable by the rotation of the threaded screw.

* * * * *